US010483689B2

(12) United States Patent
Lipke et al.

(10) Patent No.: US 10,483,689 B2
(45) Date of Patent: Nov. 19, 2019

(54) RELEASABLE CONNECTION FOR CABLES

(71) Applicant: Leviton Manufacturing Co., Inc., Melville, NY (US)

(72) Inventors: Dean Lipke, Mill Creek, WA (US); Ryan Moore, Edmonds, WA (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 16/189,036

(22) Filed: Nov. 13, 2018

(65) Prior Publication Data

US 2019/0081437 A1 Mar. 14, 2019

Related U.S. Application Data

(62) Division of application No. 15/831,000, filed on Dec. 4, 2017, now abandoned.

(60) Provisional application No. 62/430,305, filed on Dec. 5, 2016.

(51) Int. Cl.

| | |
|---|---|
| ***H01R 13/62*** | (2006.01) |
| ***H01R 43/20*** | (2006.01) |
| *H01R 24/20* | (2011.01) |
| *H01R 24/28* | (2011.01) |

(52) U.S. Cl.

CPC ..... *H01R 13/6205* (2013.01); *H01R 43/20* (2013.01); *H01R 24/20* (2013.01); *H01R 24/28* (2013.01)

(58) Field of Classification Search

CPC . H01R 13/6205; H01R 11/30; H01R 13/4538
USPC ..... 439/140, 141
See application file for complete search history.

(56) References Cited

U.S. PATENT DOCUMENTS

| | | | | |
|---|---|---|---|---|
| 3,839,697 | A * | 10/1974 | Obert | B61G 5/10 439/141 |
| 7,874,844 | B1 | 1/2011 | Fitts, Jr. | |
| 2011/0171837 | A1* | 7/2011 | Hardisty | H01R 13/6205 439/39 |
| 2017/0338578 | A1* | 11/2017 | Zhang | H01R 11/30 |

OTHER PUBLICATIONS

Non-Final Office Action received for U.S. Appl. No. 15/831,000 dated Aug. 13, 2018, 12 pages.

* cited by examiner

*Primary Examiner* — Ross N Gushi
(74) *Attorney, Agent, or Firm* — Amin, Turocy & Watson, LLP

(57) ABSTRACT

Embodiments of the present disclosure provide a releasable connection, which may include a first housing to couple to a first cable. The housing may include a mating surface to couple with a mating surface of a second housing that may couple to a second cable. The transmission components of the first cable may extend to the mating surface, to provide connection with respective transmission components of the second cable in response to a mating of the first and second mating surfaces. The connection may further include a retention mechanism, which may include a magnet component disposed on or in proximity to the mating surface, to interact with a corresponding magnet component of the second housing. A magnetic force produced in response to the interaction may provide the releasable coupling of the first and second cables. Other embodiments may be described and/or claimed.

20 Claims, 9 Drawing Sheets

RELEASABLE CONNECTION FOR CABLES

RELATED APPLICATION

This application is a divisional of, and claims priority to, U.S. patent application Ser. No. 15/831,000, filed on Dec. 4, 2017, and entitled "A RELEASABLE CONNECTION FOR CABLES," which claims priority to U.S. Provisional Patent Application No. 62/430,305, filed on Dec. 5, 2016. The entireties of these related applications are incorporated herein by reference.

FIELD

Embodiments of the present disclosure generally relate to the field of network connectivity, and more particularly, to providing break-away connectors and couplers for communications network components.

BACKGROUND

In a communications network, multiple devices may be connected with each other and other entities via different cable- or cord-based (e.g. structured copper or optical fiber cabling; copper or optical fiber patch cables; copper or optical fiber patch cords; copper and optical fiber power cords and the like (collectively "cable" or "cables")) connections and corresponding mating elements (e.g. outlets, plugs, jacks, copper or optical fiber connectors and the like (collectively "connectors"). In some instances, such cables may be damaged. For example, a connectorized cable may be plugged into a piece of equipment, to connect the equipment with a power or data connector disposed on the wall of a facility space.

In some instances, the equipment, such as a computing device or other type of machine, may be movable. For example, the equipment may be disposed on a medical cart or table in a hospital room. When the cart or table is rolled or moved away from the connector in the wall, to which a machine is connected, a pulling force to the cable may be applied. In the absence of a release mechanism, the equipment may be pulled off the cart or table and damaged. In another example, a connector may be pulled out of the wall plate, which may result in costly damage to the connector or wall plate. In either instance, costly damage of the network infrastructure may occur.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example and not by way of limitation in the figures of the accompanying drawings.

DETAILED DESCRIPTION

Some embodiments of the present disclosure include techniques and configurations for a connector to releasably couple two cables. In one instance, a connector may include a first housing to couple to a first cable. The housing may include a mating surface to mate with a mating surface of a second housing, to couple to a second cable. The transmission components of the first cable may extend to the mating surface, to provide connectivity with respective transmission components of the second cable, in response to a coupling of the first and second mating surfaces. The connector may further include a retention mechanism, to provide for releasable coupling of the cables. The retention mechanism may include a magnet component disposed on or in proximity to the mating surface, to interact with a corresponding magnet component of the second housing. A magnetic force produced in response to the interaction may provide the releasable coupling of the first and second cables.

Figure 1:
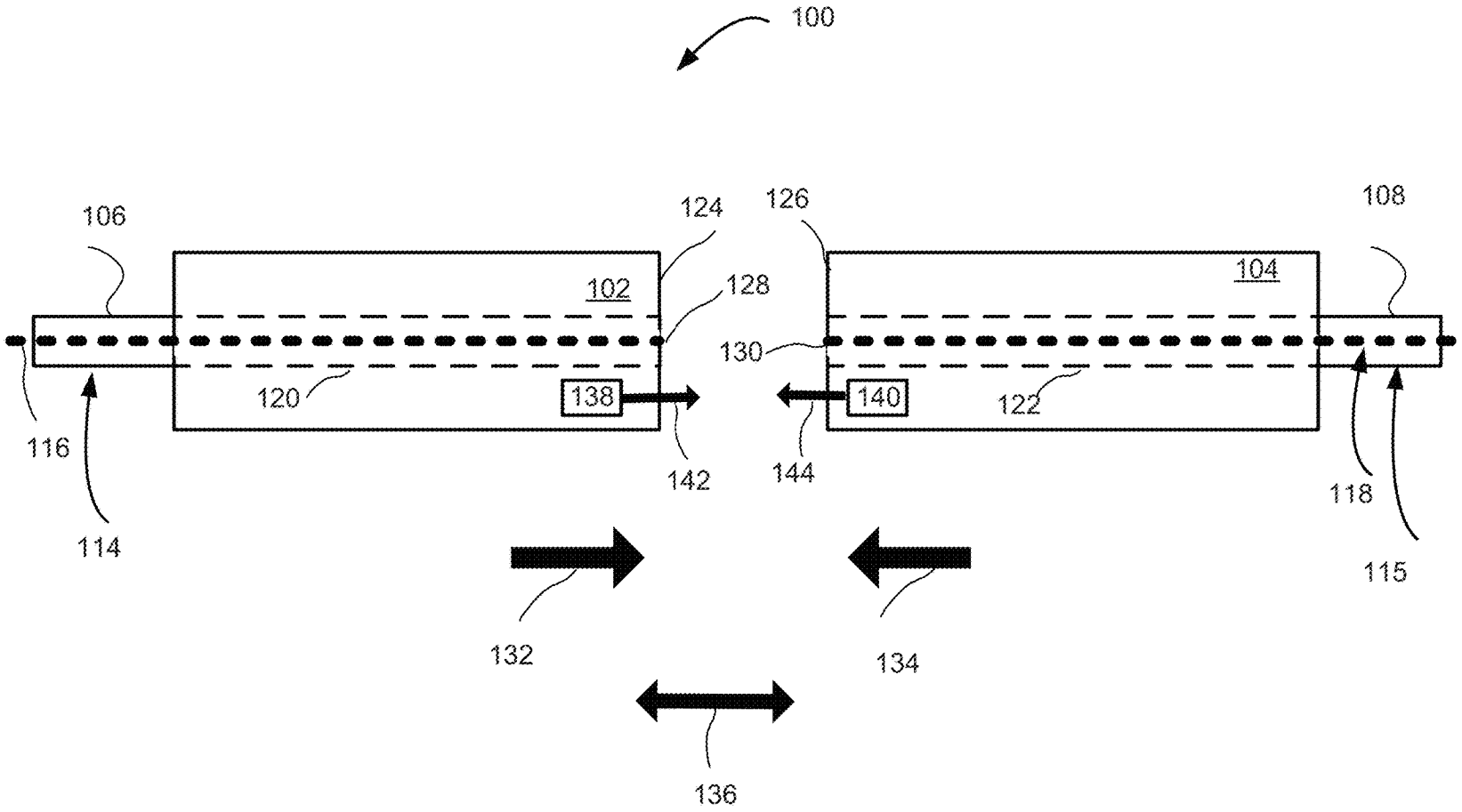
FIG. 1 illustrates a schematic diagram of an example releasable connection, in accordance with some embodiments.

FIG. 1 illustrates a schematic diagram of an example releasable connection 100, in accordance with some embodiments. In embodiments, the connection 100 may comprise a connector configured to releasably couple first and second cables 106, 108, provide connection between the first and second transmission components of the first and second cables 106, 108, and further provide a break-away damage-free release of the first and second cables 106, 108 in response to a pulling force applied to one or both of the cables.

In embodiments, the connection 100 may comprise a connector that may include a first housing 102 to couple to a first cable 106, and a complementary second housing 104 to couple to a second cable 108. For ease of understanding, only parts of the first and second cables 106 and 108 are shown in FIG. 1. In general, first cable 106 and second cable 108 may have different lengths and connect different types of equipment at opposing ends.

First and second cables 106 and 108 may include one or more set of first transmission components 116 and set of second transmission components 118 (e.g. twisted wire pair or optical fibers), respectively, disposed inside a first cable jacket 114 and second cable jacket 115. The number of transmission components inside the jacket 114 may vary, depending on technical requirements of the first and second cables 106 and 108. The first and second transmission components 116, 118 are shown in FIG. 1 for illustrative purposes and this illustration is not limiting to this disclosure. The first and second transmission components 116 and 118, which may be disposed inside respective first and second portions 120 and 122 of the first and second jackets 114, 115 correspond to the first and second cables 106 and 108. The first housing 102 may include a first mating surface 124, and the second housing 104 may include a corresponding second mating surface 126 configured to mate with the mating surface 124. As shown in FIG. 1, the first and second transmission components 116 and 118 may extend to, and in some embodiments, protrude from, the respective first and second mating surfaces 124 and 126. The first and second transmission components 116 and 118 may have respective first and second signal transmission elements (e.g. conductive contacts or contact ends (tips), or optical fibers, or optical fiber tips) 128 and 130. The first and second signal transmission elements 128 and 130 may have corresponding first and second contacting surfaces to couple to the contacting surfaces of the other, and provide connectivity for signal or power transmission through the first and second transmission components 116 and 118, in response to a mating of the first housing 102 with the second housing 104 via their respective first and second mating surfaces 124 and 126. The mating of first and second housings 102 and 104 may be provided by bringing the first and second mating surfaces 124 and 126 in contact with each other, as indicated by arrows 132 and 134.

In embodiments, the connector 100 may include a retention mechanism, to retain the first housing 102 in contact with the second housing 104, and provide a break-away release of the first and second housings 102 and 104 in response to application of a pulling force (indicated by arrow 136). The retention mechanism may include a first magnet component 138 disposed on or inside the first housing 102. For example, the first magnet component 138 may be disposed on, or in proximity to, the first mating surface 124. The retention mechanism may further include a second mating magnet component 140 disposed on or inside the second housing 104, such as on, or in proximity to, the second mating surface 126. The first and second magnet components 138 and 140 may have reverse polarities to produce a magnetic force (indicated by arrows 142 and 144 respectively) in response to interaction between the magnet components 138 and 140. The first and second magnetic components 138 and 140 may be selected to produce the magnetic force 142, 144, with desired magnitude, to provide for releasable mating of the first and second housings 102 and 104 and the corresponding releasable mating of the first and second cables 106 and 108. In some embodiments, the retention mechanism may include only one magnet (e.g., 138 or 140) disposed on or in proximity to a mating surface, while another mating surface may comprise a magnetizable material (e.g., metal) responsive to the magnetic field provided by the magnet.

Figure 2:
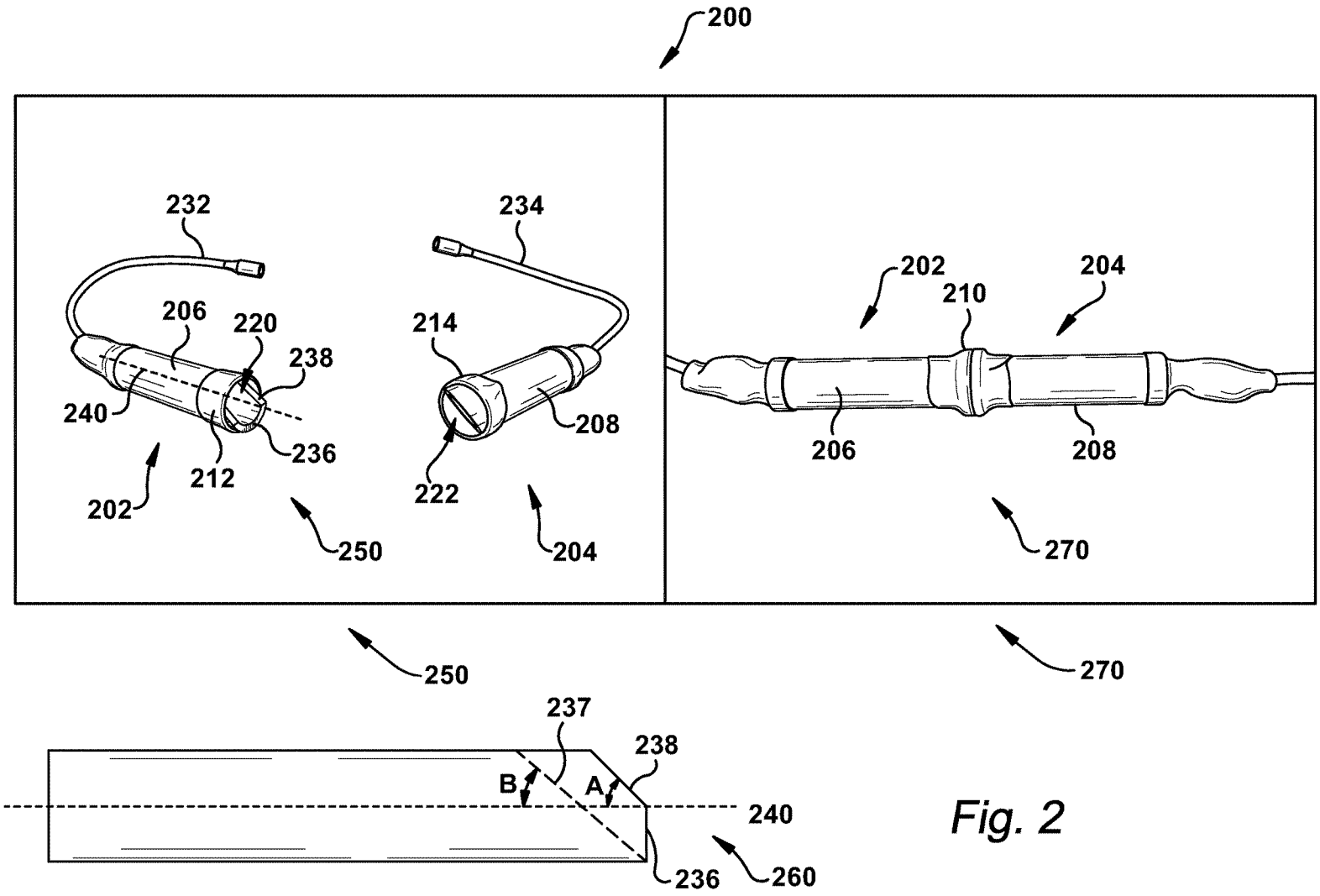
FIG. 2 illustrates an example releasable connection, in accordance with some embodiments.

FIG. 2 illustrates an example releasable connection 200 in accordance with some embodiments. The connection 200 may include first and second connectable portions 202 and 204, respectively. The first and second connectable portions 202, 204 of the connection 200 are shown in a disconnected (break-away) state (view 250) and in a connected state (view 270). In embodiments, the first and second connectable portions 202 and 204 may comprise a first housing 206 and a second mating housing 208, respectively. As shown, the first and second housings 206 and 208 may comprise substantially tubular bodies, with a hollow space inside, to couple to respective first and second cables 232, 234, respectively. The first and second housings 206 and 208 may include respective first and second mating surfaces 220 and 222.

In order to provide desired retention force, the first mating surface 220 may be defined by a first portion 236 mated with a second portion 238. As schematically shown in a side view 260 of the first connectable portion 202, the first portion 236 of the first mating surface 220 may be formed substantially orthogonally to the housing longitudinal axis 240. The second portion 238 of the first housing 206 may be formed under an angle A (e.g., oblique angle) to the axis 240. In some embodiments, the first mating surface 220 may comprise only a first portion 236 formed substantially orthogonally to the axis 240. In some embodiments, the first mating surface 220 may comprise only a portion having a mating face 237 that may be formed under an angle B (e.g., oblique angle) to the axis 240. For example, the first mating surface 220 may be formed by cutting the first tubular housing 206 to provide the shape of the mating surface 220. The second mating surface 222 may conform to the first mating surface 220 to provide for coupling of the first and second housings 206 and 208, as shown in view 270. The functional advantage of the described geometry may include the ability for male and female connectors to mate, while disallowing a male-male mating. For the purposes of this embodiment, a male connector may be 208 and female connector may be 206.

The transmission components of the first and second cables 232, 234 (transmission components not shown in FIG. 2) may protrude to the planes of respective first and second mating surfaces 220, 222, to provide connection 200, and signal and power transmission, between first and second cables 232, 234 as shown in view 270.

In the example embodiment of FIG. 2, the first and second mating surfaces 220, 222 are shown as defining hollow spaces. In some embodiments, the hollow spaces may be partially or fully filled, to form the first and second surfaces 220, 222, similar to those described in reference to FIG. 1. Accordingly, in some embodiments, the first and second mating surfaces 220, 222 may be formed in the planes disposed substantially orthogonally to the respective first and second housing 206, 208 longitudinal axes. In some embodiments, the first and second mating surfaces 220, 222 may be formed in the planes disposed substantially non-orthogonally to the respective first and second housing 206, 208 longitudinal axes. In some embodiments, the first mating surface 220 (and corresponding second mating surface 222) may be formed in combination of a plane disposed substantially orthogonally to the respective first and second housing 206, 208 longitudinal axes with a plane disposed substantially non-orthogonally to the respective first and second housing 206, 208 longitudinal axes A retention mechanism 210 may be disposed around the housings 206 and 208. In this embodiment, the retention mechanism 210 may include magnetic components disposed inside respective covers 212 and 214. As shown, the covers 212 and 214 may comprise perimeter rings and may be disposed adjacent to, and around, respective mating surfaces of the housings 206 and 208.

Figure 3:
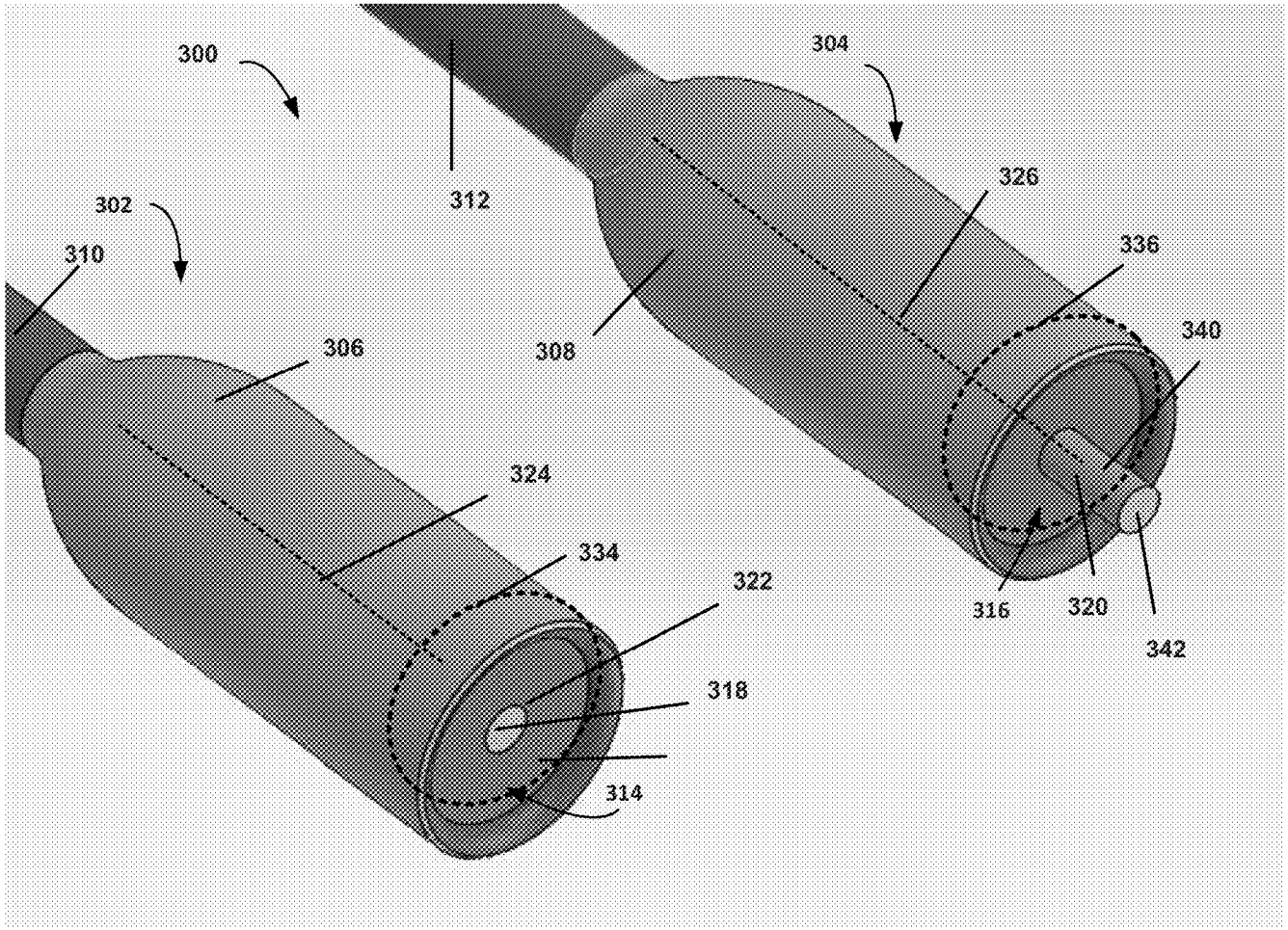
FIG. 3 illustrates another example releasable connection, in accordance with some embodiments.

FIG. 3 illustrates another example releasable connection 300, in accordance with some embodiments. Specifically, FIG. 3 shows perspective views of first and second connectable portions 302 and 304 comprising a releasable connection 300. For purposes of illustration, the first and second connectable portions 302, 304 of the connection 300 are shown in a disconnected state. In embodiments, the first and second connectable portions 302 and 304 may comprise a first housing 306 and a second complementary mating housing 308, respectively. The first and second housings 306 and 308 may comprise substantially tubular bodies, with a space inside, to couple to respective first and second cables 310, 312. The first and second housings 306 and 308 may include respective first and second mating surfaces 314 and 316. As discussed in reference to FIG. 1, the first and second cables 310, 312 may include one or more transmission components to be coupled by the releasable connection 300. In the illustrative embodiment of FIG. 3, the first and second cables 310, 312 may include at least one signal or power transmission element suitable for the transmission of signal or power with respective first and second transmission components 318, 320. As shown, one of the transmission components (e.g., 320) may comprise a signal or power transmission element pin or fiber 340 that may protrude through the mating surface 316. The mating transmission component 318 may be coupled to the housing 306. To connect the transmission components 318, 320 of the cable, the connectable portion 302 may be brought in contact with connectable portion 304. As a result, the pin or fiber 340 may be inserted in the aperture 322, to meet the transmission component 318 (coupled to the housing 306). Accordingly, the connection 300 may include male and female connectable portions (304 and 302 respectively).

As shown, the transmission component 320 may have a contacting surface 342. In the illustrated embodiment, the contacting surface 342 may be formed by cutting the pin or fiber 340 under a substantially direct angle to a longitudinal axis 326 of the housing 308. (The contacting surface of the transmission component 318 may be formed in a similar fashion.) In some embodiments, discussed in reference to FIG. 4 in more detail, the contacting surfaces may be formed by cutting the pin or fiber 340 under a oblique angle to the axis 326, and forming the transmission component 318 under an angle to a longitudinal axis 324 of the housing 306.

In embodiments, the connection 300 may include a retention mechanism, to retain the first and second connectable portions 302 and 304 in a connected position. The retention mechanism may provide a break-away release of the first and second connectable portions 302 and 304 in response to application of a pulling force to at least one of the connectable portions. In some embodiments, the retention mechanism may include one or more magnet components. For example, one of the mating surfaces 314 or 316 may comprise a magnet, while another may be made of a magnetizable (e.g., metallic) material. In another example, both mating surfaces may comprise magnets with reverse polarities, to provide a retaining force for the first and second connectable portions 302 and 304.

In some embodiments, the mating surfaces 314 and 316 may be formed under a direct angle to respective longitudinal axes 324 and 326 of the housings 306 and 308. In some embodiments, the respective mating surfaces 334 and 336 (indicated by dotted lines) may be formed under a oblique (e.g., acute) angles relative to the axes 324 and 326 of the housings 306 and 308.

Figure 4:
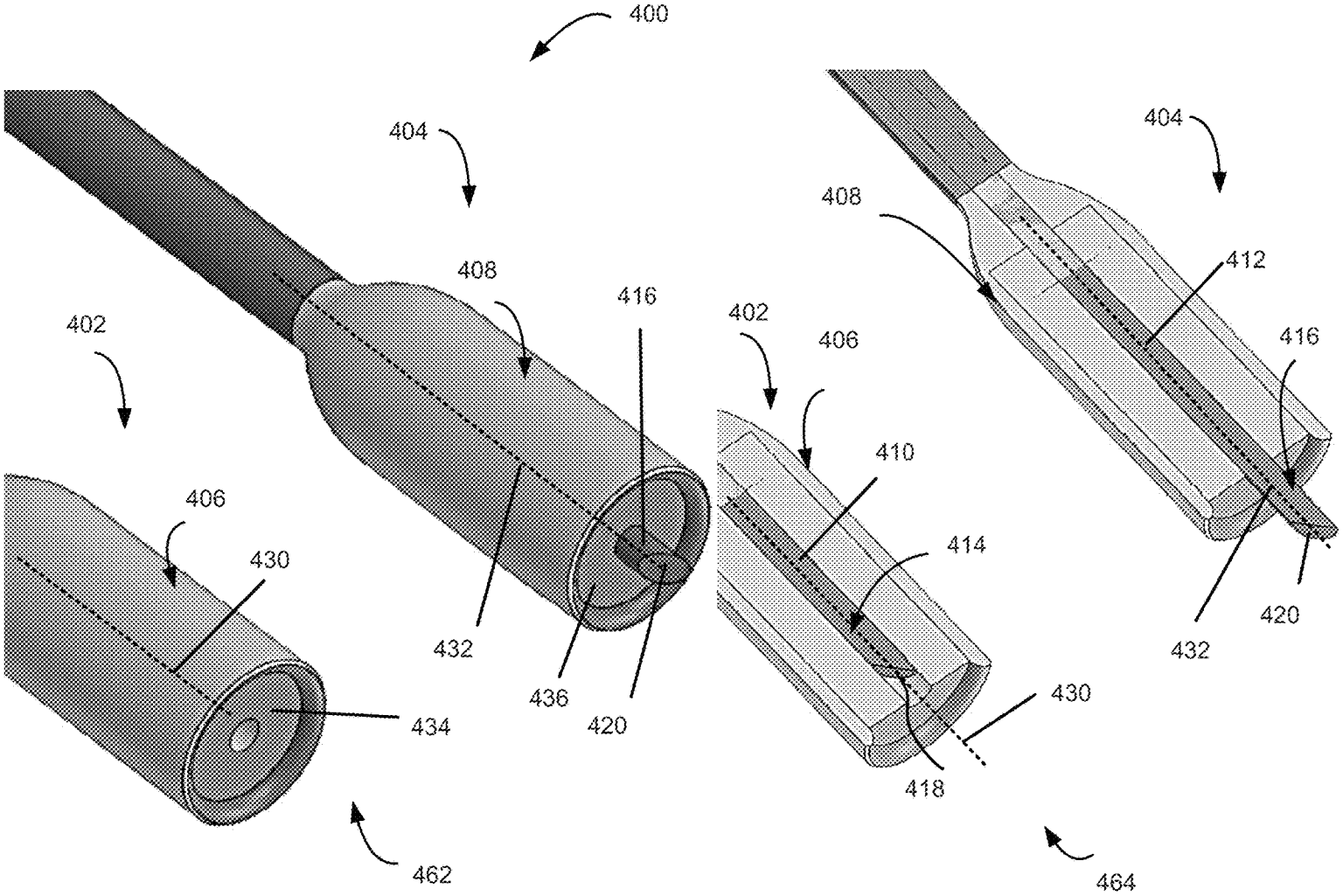
FIG. 4 illustrates yet another example releasable connection, in accordance with some embodiments.

FIG. 4 illustrates another example releasable connection 400, in accordance with some embodiments. Specifically, FIG. 4 shows a perspective view 462 and cross-sectional view 464 of first and second connectable portions 402 and 404 comprising a releasable connection 400. The connection 400 may be configured substantially similar to the connection 300 of FIG. 3. For example, the first and second connectable portions 402 and 404 may comprise first and second housings 406 and 408 similar to those described in reference to FIG. 3, to couple to portions of a single-transmission component cable. As shown, respective transmission components 410 and 412 of the cable to be connected by the connection 400 may include respective signal or power transmission elements 414 and 416. The signal or power transmission elements 414 and 416 may have respective contacting surfaces 418 and 420. As shown, the contacting surfaces 418 and 420 may be formed by cutting the transmission components 410 and 412 on the bias, e.g., under an oblique angle to respective longitudinal axes 430 and 432 of the first and second housings 406 and 408. Beneficially, the contacting surfaces 418 and 420 may have a larger surface space for signal or power transmission elements, compared to contacting surfaces provided by cutting the transmission components under a direct angle to the longitudinal axes. Further, using direct-angled contacting surfaces may result in the contact force counteracting the force of the releasable connector, which may overwhelm even strong magnets. Advantageous use of oblique angled contacting surfaces may mitigate this problem.

The mating surfaces 434 and 436 of the first and second connectable portions 402 and 404 are shown as formed under a substantially direct angle to the axes 430 and 432. In some embodiments, the mating surfaces 434 and 436 may be provided under oblique angles to the axes 430 and 432, similar to the embodiments described in reference to FIG. 3.

Figure 5:
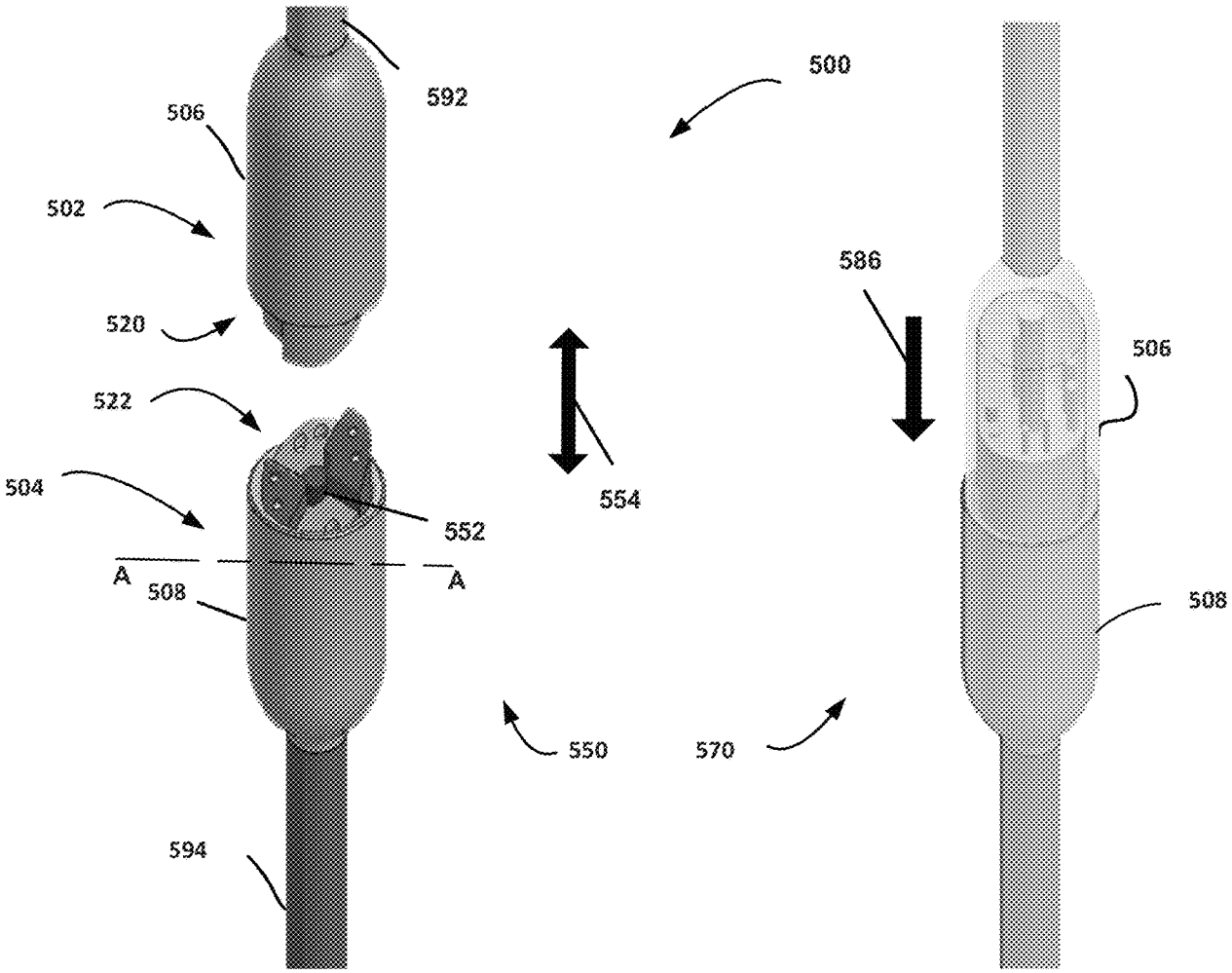
FIGS. 5-7 illustrate still another example releasable connection, in accordance with some embodiments.
Figure 6:
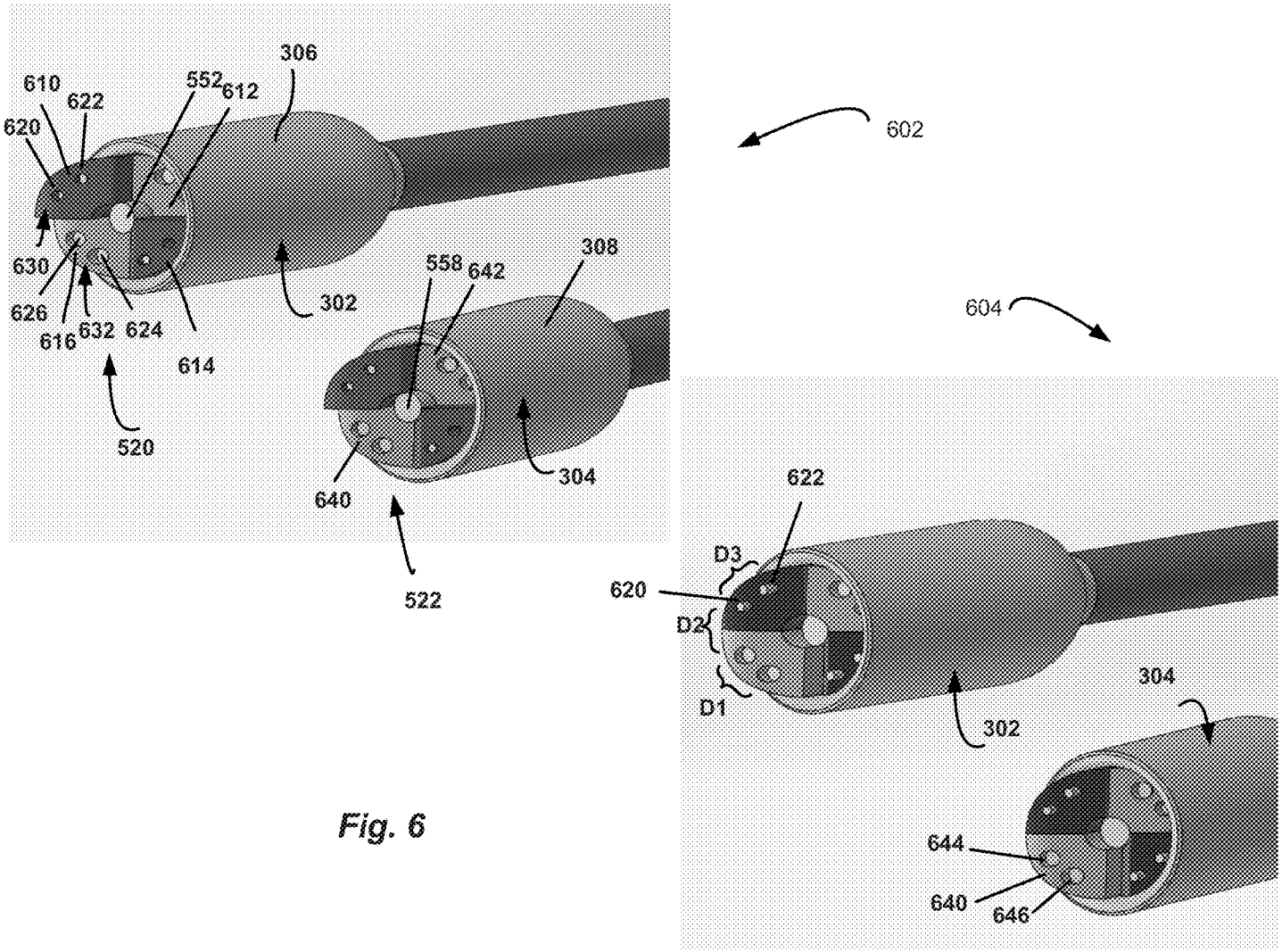
Figure 7:
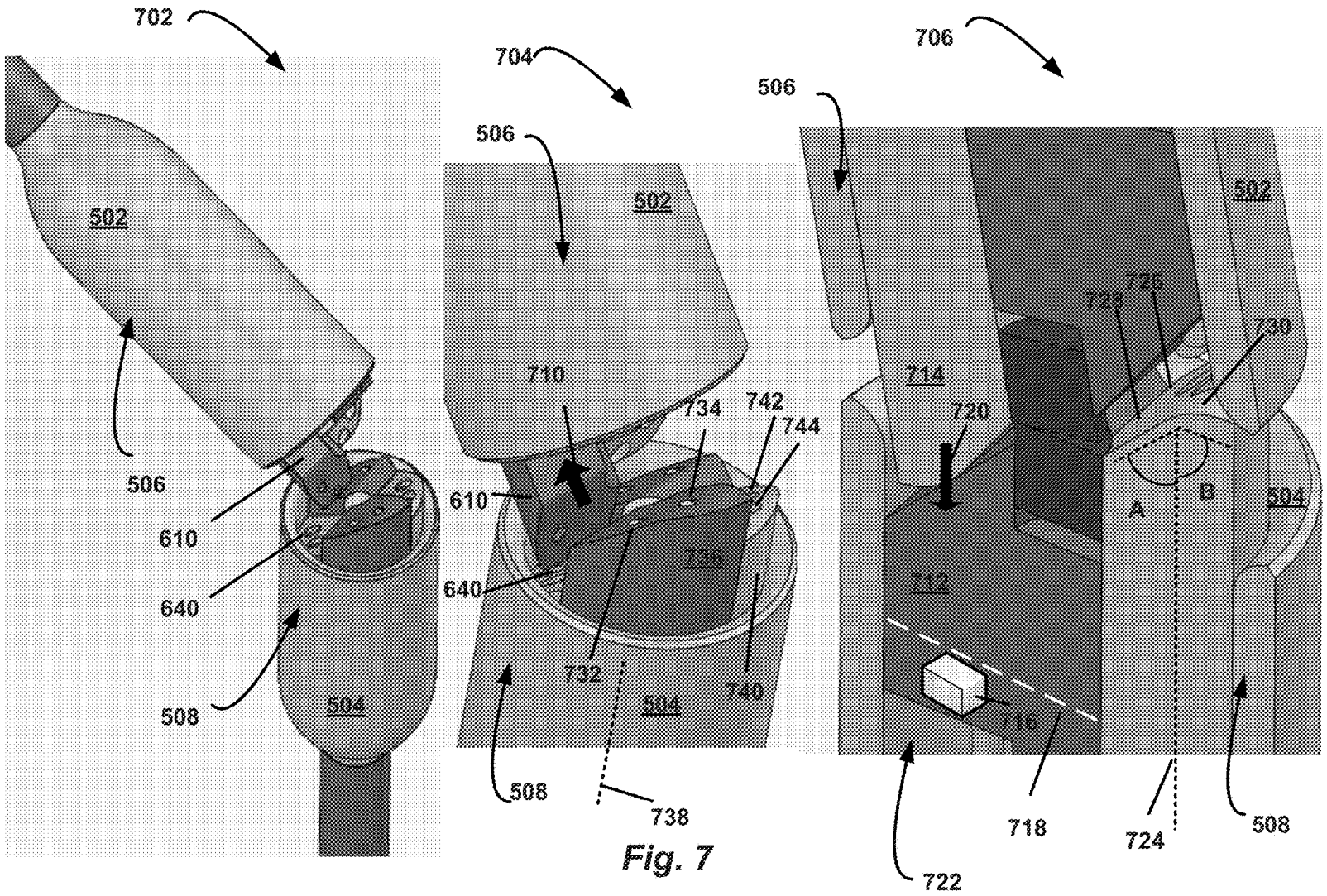

FIGS. 5-7 illustrate still another example releasable connection 500, in accordance with some embodiments. For ease of understanding, like components illustrated in FIGS. 5-7 are indicated by like numerals.

FIG. 5 illustrates perspective side views of the example releasable connection 500 in accordance with some embodiments. The connection 500 may include first and second connectable portions 502 and 504. The first and second connectable portions 502, 504 of the connection 500 are shown in disconnected and fully connected states (views 550 and 570 respectively). In embodiments, the first and second connectable portions 502 and 504 may comprise a first housing 506 and a second mating housing 508 respectively. The first and second housings 506 and 508 may comprise substantially tubular bodies to couple to first and second cables 592, 594. The first and second housings 506 and 508 may include respective first and second mating surfaces (ends) 520 and 522. As discussed in reference to FIG. 1, the first and second cables may include one or more transmission components to be connected by a releasable connection. In the illustrative embodiment of FIGS. 5-7, the first and second cables may include at least one transmission component (e.g. copper wires, optical fibers). Accordingly, each of the first and second connectable portions 502, 504 may include at least one signal or power transmission element (e.g. copper contacts, optical fibers) to be connected by the connection 500 in response to a connection of the first and second connectable portions 502, 504. It is understood that the first and second cables connectable by the releasable connection 500 may include any number of transmission components (e.g., one, two, four, six, twelve, etc.). The illustrative connection 500 to connect, for instance, an eight-wire cable, is described herein for purposes of illustration, and is not limiting this disclosure which is, for example, equally applicable to a connection 500 comprised of optical fibers.

FIG. 6 illustrates perspective front views 602 and 604 of the first and second connectable portions 502, 504 of the releasable connection 500, in accordance with some embodiments. As shown, the mating surface 520 may include a plurality of signal or power transmission elements 610, 612, 614, and 616, each of which may include one or more (in the case of the example connection 500, two) electrical contacts. For example, the signal or power transmission element 610 may include electrical contacts 620 and 622, and the signal or power transmission element 616 may include electrical contacts 624 and 626. The electrical contacts may be disposed at a distance from each other, to reduce (minimize or eliminate) cross-talk. Also, the wires having electrical contacts 620, 622, 624, and 626 may be coupled to the housing 306 (and respective mating components) such as to avoid twisting, and provide pass-through electrical connectivity with optimized (reduced or eliminated) loss. In some embodiments, the electrical contacts (e.g., their contact surfaces) may be disposed substantially equidistant relative to imaginary centers of transverse cross-sections of the housings 506, 508 (an example transverse cross-section is indicated by line A-A in view 550).

More specifically, the electrical contacts 620, 622, 624, and 626 (and corresponding wires) may be coupled to the housing 306 and respective mating components to be equidistant from each other. In other words, as shown in view 604, distances D1, D2, and D3 between the contacts may be equal. In some embodiments, each pair of contacts (e.g., 620 and 622, and 624 and 626) and corresponding wires may be coupled to the housing 306 to have equal distance between each contact in a pair, e.g., the distance between 620 and 622 may be equal to the distance between 624 and 626. In other words, distance D1 may be equal to distance D3.

In some embodiments, some of the mating components may be movable longitudinally inside the housing 306. For example, components 610 and 614 may comprise plungers, which may be loaded (e.g., spring-loaded or otherwise configured) to be extended in a default (disconnected) state, shown in view 602. In some embodiments, the contacts 620, 622 extending inside the plunger 610 (and similarly contacts extending inside the plunger 614) may comprise pins, such as pogo pins or other types of pins. As shown, in the default (extended) state of the plunger 610, the contacts (pins) 620, 622 may be disposed to be underneath a surface 630 of the plunger 610. Thus, in a disconnected state of the connectable portions 302, 304 (view 602), the contacts (pins) may be protected by virtue of being fully disposed inside the plungers 610 and 614.

The plungers 610 and 614 (and other plungers of the connectable portions 502, 504) may mate with respective non-plunger components 640, 642, in response to application of a force 586, shown in view 570 of FIG. 5.

View 604 illustrates the connectable portions 502 and 504 with the plunger components shown in positions corresponding to the connected state of the connectable portions 502 and 504. The plungers 610 and 614 may be pushed inside the housing 306 (at least partially), in response to a contact with mating components 640 and 642 of the connectable portion 304. As a result, electrical contacts (pins) 620 and 622 of the plunger 610 (and respective contacts disposed inside the plunger 614) may be exposed, as shown in view 604. Such exposure of contacts (pins) 620 and 622 may provide sufficient electrical contact with mating electrical contacts 644, 646 of the mating component 640. Similar effect may be achieved with respect to the plunger 614, as well as with respect to the plungers of the connectable portion 304.

The contacts 624 and 626 of the mating component 616 (as well as the contacts of the mating component 612 and contacts 644 and 646 referenced above) may comprise conductive pads. In some embodiments, the pads 624 and 626 may be disposed inside the mating component 616, e.g., underneath a surface 632 of the component 616. Similarly, the contacts of the mating component 612 may be disposed inside the mating component 612, underneath the surface of the mating component.

In embodiments, the connector 300 may include a retention mechanism, to retain the connectable portions 502 and 504 in a connected position, illustrated in view 570. The retention mechanism may provide a break-away release of the connectable portions 302 and 304 in response to application of a pulling force (indicated by arrow 554 in FIG. 5). In some embodiments, the retention mechanism may include a magnet 552 (shown in FIGS. 5 and 6), which may be disposed in the middle of (e.g., between) the mating components of the connectable portion 502. A mating magnet 558 with a reverse polarity (shown in FIG. 6) may be disposed between the respective mating components in the connectable portion 304. In some embodiments, one of the components 552, 558 may be a magnet, and another may comprise a magnetizable material responsive to a magnetic field generated by the magnet.

In some embodiments, the retention mechanism may include multiple magnet components disposed around mating surfaces of the connectable portions of the releasable connector. Some example retention mechanisms with multiple magnets will be described in reference to FIG. 7.

FIG. 7 illustrates perspective views of connectable portions of the connector of FIGS. 5-6, in accordance with some embodiments. More specifically, views 702, 704, and 706 illustrate a process of connecting the connectable portions 302 and 304 of the releasable connector 300. As shown in views 702 and 704, the plunger 610 of the connectable portion 302 may come into contact with the mating component 640 of the connectable portion 304, in response to bringing these portions in contact. As a result of a pressure provided by the mating component 640, the plunger 610 may be moved from its default (e.g., extended) position toward the inside of the housing 306, as indicated by arrow 710.

As discussed above, the retention mechanism of the connector may include multiple magnets. At least some of these magnets may be disposed, e.g., embedded in or attached to, the mating components of the connector 500.

For example, a magnet may be disposed inside a plunger. In the example shown in view 706, the magnet 716 may be disposed inside the plunger 712 of the connectable portion 504. More specifically, the plunger 712 may be at least partially hollow inside, to allow a disposition of a magnet inside the plunger 712 (in addition to contacts, not visible in view 706). Such disposition of a magnet may allow for a free movement of the plunger 712 down the housing 508 from its default (extended) position, in response to a contact with a respective mating component 714 of the connectable portion 502.

For example, the magnet 716 may be disposed at a distance from the top of the plunger 712 (e.g., underneath the imaginary line 718), to allow for a movement of the plunger 712 (indicated by arrow 720) in response to a contact with the mating (non-plunger) component 714. Accordingly, the magnet 716 disposed inside the plunger 712 may interact with a mating magnet (not shown) disposed inside the mating component 714 (or magnetizable material of the mating component 714). At the same time, the disposition of the magnet 716 may allow for a movement of the plunger 712 from its default position down, and subsequent exposure of the contacts disposed inside the plunger 712. In other words, the plunger 712 may not be released from its extended position unless the mating magnetic connector surface is proximal to it.

In some embodiments, the magnet 716 may be disposed inside the housing 508 in the area 722, underneath the plunger 712, to allow for a movement of the plunger 712 down from its default (loaded) position. Other plungers of the connectable portions 502 and 504 may be configured in a way similar to one described in reference to view 706.

In some embodiments, the plungers (e.g., 712) may be made of a magnetizable material, and their respective mating components (e.g., 714) may include magnets, to interact with the magnetizable material of respective plungers, and provide a retention force to retain the connectable portions 502 and 504 together.

In some embodiments, the magnets of a retention mechanism of the releasable connector may comprise electromagnets, whose polarities may be controlled, e.g., remotely. For example, the magnets of the connectable portion 502 may have one polarity, while the magnets of the connectable portion 504 may have a reverse polarity, to provide retention forces for the connectable portions in the connected state. In order to disconnect the connectable portions remotely, the polarities of the magnets of one portion (e.g., 502) may be reversed, to assume the same polarity as the magnets of another portion (e.g., 504), in order to provide a repulsion force to disconnect the connectable portions.

In some embodiments, as may be seen in view 706, mating surfaces of the mating components may be disposed under an oblique (e.g., acute) angle A relative to a longitudinal axis 724 of the housing 508. In some embodiments, the mating surfaces (e.g., mating surface 726) may have a combination surface comprising a first portion 728 disposed under the angle A and a second portion 730 disposed under an oblique angle B relative to the axis 724, as shown.

As described in reference to FIG. 4, in some embodiments, the electrical contacts, disposed at respective ends of electrical wires comprising the cable to be connected by the connector, may likewise be formed under a oblique angle relative to the longitudinal axis of the housing of the connectable component. For example, as shown in view 704, the contacts (pins) 732 and 734 of the plunger 736 may be formed under a oblique angle to a housing axis 738. Similarly, the electrical contacts (pads) 742, 744 of the non-plunger mating component 740 may be formed under a oblique angle to the housing axis 738.

In some embodiments, the connectable portions 502 and 504 may be configured in a substantially similar manner. Accordingly, in some embodiments, the releasable connector 500 of FIGS. 5-7 may comprise a hermaphroditic type of connector.

In some embodiments the releasable connector 500 may comprise a connector with male-female connectable portions. For example, as discussed above, in some embodiments, the magnets 552 and 558 comprising a retention mechanism for the connectable portions 502, 504 may be disposed substantially at the center of respective housings 506 and 508. Accordingly, the connectable portions 502, 504 may comprise male and female connectors due to reverse polarities of the magnets 552 and 558.

Figure 8:
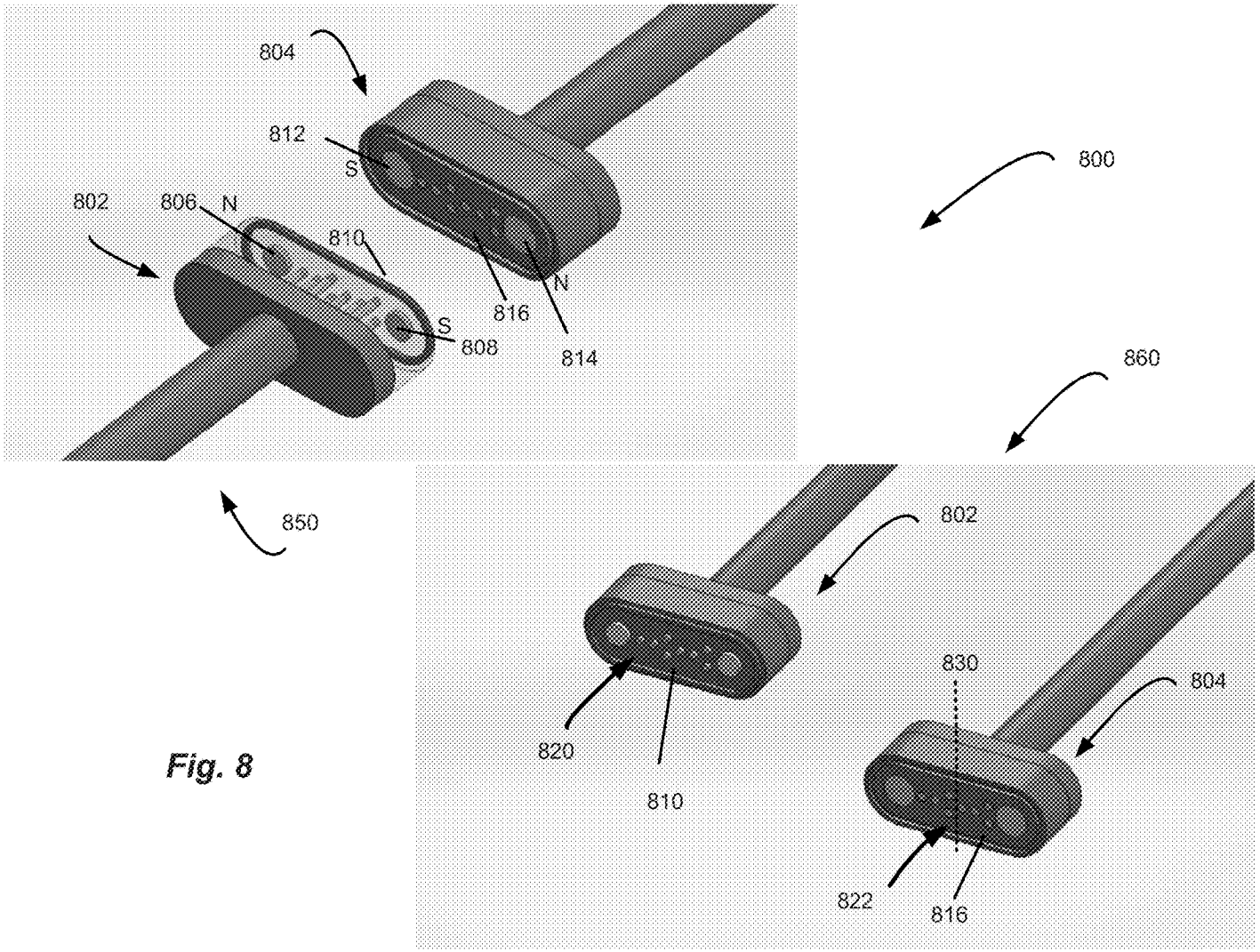
FIG. 8 illustrates yet another example releasable connection, in accordance with some embodiments.

FIG. 8 illustrates another example releasable connection 800, in accordance with some embodiments. Specifically, FIG. 8 includes perspective views 850 and 860 of the releasable connection 800. The connection 800 may include first and second connectable portions 802 and 804. One of the connectable portions (e.g., 802) may comprise a male-type connector, while another (e.g., 804) may comprise a female-type connector. View 850 includes a transparent view of the connectable portion 802, for ease of understanding. As shown, the housing of the connectable first and second portions 802 and 804 may be provided with substantially elongated first and second mating surfaces 810 and 816. The retention mechanism may include magnets 806 and 808 disposed around respective ends of the first mating surface 810 of the first connectable portion 802, and magnets 812 and 814 disposed around respective ends of the second mating surface 816 of the second connectable portion 804. To provide a desired degree of alignment at connection, the magnets of a portion may have reverse polarities. For example, the magnet 806 may have polarity N, and the magnet 808 may have polarity S (or vice versa). Correspondingly, the magnet 812 may have polarity S, and the magnet 814 may have polarity N (or vice versa).

As shown, the signal or power transmission elements (e.g., contacts, pins; optical fibers) 820 (and mating signal or power transmission elements 822) may be disposed on respective first and second mating surfaces 810 and 816. As shown, the signal or power transmission elements 820 may protrude from the first mating surface 810, to be received by respective apertures of the second mating surface 816, to meet with signal or power transmission elements 822. The mating signal or power transmission elements 822 may be disposed inside respective apertures similar to the embodiments of the housing 406 of FIG. 4. The signal or power transmission elements may be disposed around the mating surfaces in non-concentric fashion. For example, in view 860, looking at the mating surface 810 from left to right, two signal or power transmission elements may be disposed horizontally, the next two signal or power transmission elements may be disposed vertically, the next two signal or power transmission elements may be disposed horizontally, and so on. Additionally, the pins or fibers may be positioned in such a way that they are slightly non-symmetrical for the advantage of optimizing signal conductive properties.

The connection of the first and second connectable portions 802 and 804 may be achieved by inserting the signal or power transmission elements of the first mating surface 810 in the corresponding apertures of the second mating surface 816. The protrusion of the signal or power transmission elements inside corresponding apertures may provide additional means for retaining the first and second connectable portions 802 and 804 in a connected state.

In some embodiments, the first and second connectable portions 802 and 804 may comprise a hermaphroditic connection. For example, half of the signal or power transmission elements of the first mating surface 810 may comprise protruding signal or power transmission elements, and another half may comprise signal or power transmission elements disposed inside the apertures. The mating surface 816 may be configured in a similar fashion, to mate the signal or power transmission elements of the mating surface 810. For example, in view 860, respective half of the signal or power transmission elements of the mating surface 816 (e.g., to the left of imaginary line 830) may comprise apertures, and another half (e.g., to the right of imaginary line 830) may comprise protruding signal or power transmission elements (e.g. pins; optical fibers).

Figure 9:
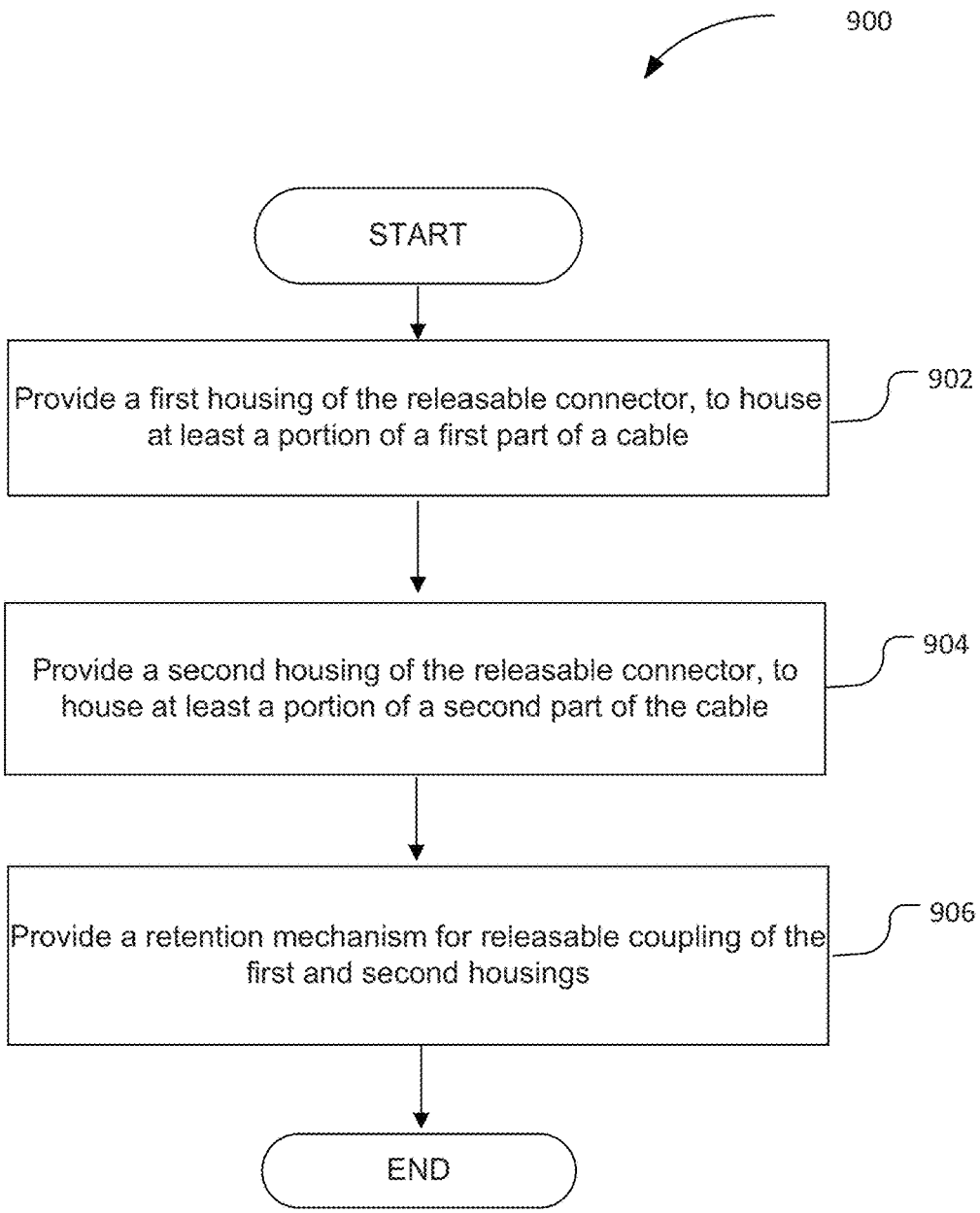
FIG. 9 illustrates an example process of providing an example releasable connection, in accordance with some embodiments.

FIG. 9 illustrates an example process of providing an example releasable connection to releasably connect two cables, in accordance with some embodiments. The actions of the process 900 may comport with embodiments described in reference to FIGS. 2-8.

The process 900 may begin at block 902, and include providing a first housing of the releasable connection, to couple to at least a portion of a first cable. Providing the first housing may include forming a first mating surface on the first housing, and disposing one or more first signal or power transmission elements of the first cable in the first housing to extend to the first mating surface.

At block 904, the process 900 may include providing a second housing of the releasable connection, to couple to at least a portion of a second cable. Providing the second housing may include forming a second mating surface on the second housing, to mate with the mating surface of the first housing, and disposing one or more second signal or power transmission elements of the second cable in the second housing, to extend to the second mating surface. The second signal or power transmission elements may provide a reversible connection with respective first signal or power transmission elements, in response to a coupling of the first and second mating surfaces.

At block 906, the process 900 may include providing a retention mechanism for releasable coupling of the first and second housings. This may include disposing at least one first magnet component on or in proximity to the first mating surface, and disposing at least one second magnet component on or in proximity to the second mating surface, to interact with the first magnet component in response to the mating of the first and second mating surfaces. A magnetic force produced in response to the interaction of the first and second magnet components may provide the releasable coupling of the first and second housings.

Various operations are described as multiple discrete operations in turn, in a manner that is most helpful in understanding the claimed subject matter. However, the order of description should not be construed as to imply that these operations are necessarily order dependent. Embodiments of the present disclosure may be implemented into a system using any suitable hardware and/or software to configure as desired.

Although certain embodiments have been illustrated and described herein for purposes of description, a wide variety of alternate and/or equivalent embodiments or implementations calculated to achieve the same purposes may be substituted for the embodiments shown and described without departing from the scope of the present disclosure. This application is intended to cover any adaptations or variations of the embodiments discussed herein. Therefore, it is manifestly intended that embodiments described herein be limited only by the claims and the equivalents thereof.

What is claimed is:

1. A connector, comprising:

a housing comprising a tubular body;

mating components that reside within the tubular body, wherein at least one of the mating components comprises a spring-loaded plunger component that is independently movable longitudinally relative to the housing, and that is configured to be extended while the connector is unmated with a mating connector and to be retracted into the housing while the connector is mated with the mating connector;

transmission components disposed in the mating components and configured to terminate conductors of a cable terminated by the connector; and a first magnet disposed in a middle of the mating components and configured to engage with a second magnet of the mating connector while the connector is mated with the mating connector.

2. The connector of claim 1, wherein engagement of the first magnet with the second magnet holds the connector and the mating connector in a mated position.

3. The connector of claim 1, further comprising multiple third magnets disposed around a mating surface of the housing, wherein the multiple third magnets are configured to engage with multiple fourth magnets of the mating connector while the connector is mated with the mating connector, and engagement of the third magnets with the fourth magnets holds the connector and the mating connector in a mated position.

4. The connector of claim 1, wherein the transmission components are disposed substantially equidistant from a center of a transverse cross-section of the housing.

5. The connector of claim 1, wherein distances between adjacent transmission components of the transmission components are equal or substantially equal.

6. The connector of claim 1, wherein at least another of the mating components other than the spring-loaded plunger component is a non-plunger component configured to make contact with another spring-loaded plunger component of the mating connector while the connector is mated with the mating connector, and a subset of the transmission components disposed in the non-plunger component are configured to make contact with other transmission components disposed in the other spring-loaded plunger of the mating connector while the connector is mated with the mating connector.

7. The connector of claim 6, wherein a first pair of transmission components, of the transmission components, is disposed in the spring-loaded plunger component, a second pair of transmission components, of the transmission components, is disposed in the non-plunger component, and a first distance between the first pair of transmission components is equal to or substantially equal to a second distance between the second pair of transmission components.

8. The connector of claim 1, wherein while the spring-loaded plunger component is extended, a subset of the transmission components disposed in the spring-loaded plunger component reside under a front surface of the spring-loaded plunger component, and while the spring-loaded plunger component is retracted into the housing, the subset of the transmission components are exposed.

9. The connector of claim 8, wherein the spring-loaded plunger component is configured to make contact with a non-plunger component of the mating connector while the connector is mated with the mating connector, and the subset of the transmission components disposed in the spring-loaded plunger are configured to make contact with other transmission components disposed in the non-plunger component while the connector is mated with the mating connector.

10. The connector of claim 1, wherein the transmission components comprise at least one of optical fibers or electrically conductive contacts.

11. The connector of claim 1, wherein the mating components comprise a first pair of opposing mating components, including the at least one of the mating components, that comprise spring-loaded plunger components, and a second pair of opposing mating components that comprise non-plunger components.

12. A connector comprising:

a tubular housing having disposed therein mating components, wherein at least one of the mating components comprises a spring-loaded plunger that extends beyond a front surface of the tubular housing and that retracts into the housing in response to pressure applied to the spring-loaded plunger, the mating components have disposed therein transmission components configured to terminate conductors of a cable, and the connector further comprises a first magnet disposed between the mating components and configured to engage with a second magnet disposed inside another connector.

13. The connector of claim 12, wherein the transmission components are spaced equally or substantially equally from a center of a transverse cross-section of the tubular housing.

14. The connector of claim 12, wherein the at least one of the mating components is a first mating component, and a second mating component of the mating components comprises a non-plunger component.

15. The connector of claim 14, wherein the first mating component is configured to connect to another non-plunger component of another connector while the connector is mated with the other connector, and the second mating component is configured to connect with another plunger of the other connector while the connector is mated with the other connector.

16. The connector of claim 12, wherein a subset of the transmission components disposed in the spring-loaded plunger are covered by the spring-loaded plunger while the spring-loaded plunger is extended and are exposed while the spring-loaded plunger is retracted into the tubular housing.

17. A cable connector, comprising:

a tubular connector housing; and transmission components disposed within mating components that reside within the tubular connector housing, wherein at least one of the mating components is a spring-loaded component that moves, independently of the tubular connector housing and the other mating components, to retract into the tubular connector housing in response to a force applied to the at least one of the mating components as the cable connector is mated with another cable connector, and the mating components comprise a first pair of opposing mating components, including the at least one of the mating components, that comprise spring-loaded plunger components, and a second pair of opposing mating components that comprise non-plunger components.

18. The cable connector of claim 17, further comprising first magnets disposed around a mating surface of the tubular connector housing, wherein the first magnets are configured to engage with second magnets of the other cable connector while the cable connector is mated with the other cable connector.

19. The cable connector of claim 17, wherein the transmission components are disposed substantially equidistant from a center of a transverse cross-section of the tubular connector housing.

20. The cable connector of claim 17, wherein while the spring-loaded component is extended, a subset of the transmission components disposed in the spring-loaded component reside under a front surface of the spring-loaded component, and while the spring-loaded component is retracted into the tubular connector housing, the subset of the transmission components are exposed.

* * * * *